US012339087B2

(12) United States Patent
Stephens et al.

(10) Patent No.: US 12,339,087 B2
(45) Date of Patent: Jun. 24, 2025

(54) GAS BLOCK FOR A FIREARM

(71) Applicant: JKJD Ventures, LLC, Montgomery, TX (US)

(72) Inventors: Maddison Danielle Stephens, Montgomery, TX (US); Isaac Daniel Stephens, Montgomery, TX (US)

(73) Assignee: JKJD Ventures, LLC, Montgomery, TX (US)

( * ) Notice: Subject to any disclaimer, the term of this patent is extended or adjusted under 35 U.S.C. 154(b) by 0 days.

(21) Appl. No.: 18/361,703

(22) Filed: Jul. 28, 2023

(65) Prior Publication Data

US 2025/0035392 A1 Jan. 30, 2025

(51) Int. Cl.
*F41A 5/26* (2006.01)

(52) U.S. Cl.
CPC ..... *F41A 5/26* (2013.01)

(58) Field of Classification Search
None
See application file for complete search history.

(56) References Cited

U.S. PATENT DOCUMENTS 2,582,989 A * 1/1952 Harvey ..... F41A 5/26 89/193
3,333,509 A * 8/1967 Muhlemann ..... F41A 5/28 89/193
3,333,510 A * 8/1967 Muhlemann ..... F41A 5/26 89/193
3,893,370 A * 7/1975 Hutton ..... F41A 5/26 89/193
5,103,714 A * 4/1992 LaFrance ..... F41A 5/26 89/129.01
8,596,185 B1 * 12/2013 Soong ..... F41A 5/28 89/193
8,960,069 B1 * 2/2015 Soong ..... F41A 5/28 89/193
2010/0251885 A1 * 10/2010 Stone ..... F41A 5/26 89/193
2010/0282066 A1 * 11/2010 Tankersley ..... F41G 11/003 42/108
2014/0224114 A1 * 8/2014 Faxon ..... F41A 5/28 89/193
2016/0202006 A1 * 7/2016 Daley, Jr. ..... F41A 5/26 89/193
2017/0276445 A1 * 9/2017 Daley, Jr. ..... F41A 5/26
2019/0170461 A1 * 6/2019 Leitner-Wise ..... F41A 11/00
(Continued)

OTHER PUBLICATIONS

Wojtek Weaponry .750 Adjustable Clamp Gas Block (Aug. 2023) https://www.wojtekweaponry.com/750-Blocks_c_115.html—(6 pages).

*Primary Examiner* — Derrick R Morgan
(74) *Attorney, Agent, or Firm* — Eversheds Sutherland (US) LLP

(57) ABSTRACT

A gas block for a firearm may include a body, a barrel bore extending from a first end to a second end of the body and configured to receive a portion of a barrel therein, a gas tube bore extending from the first end toward the second end and configured to receive a portion of a gas tube therein, a gas port extending from the barrel bore to the gas tube bore, and an alignment aperture extending from the gas tube bore to a top side of the body and coaxial with the gas port, with the alignment aperture being configured to allow visualization of alignment of the gas port with a barrel gas port of the barrel.

18 Claims, 6 Drawing Sheets

(56) References Cited

U.S. PATENT DOCUMENTS

| | | | | |
|---|---|---|---|---|
| 2019/0226786 | A1* | 7/2019 | Sloan | F41A 5/26 |
| 2019/0346223 | A1* | 11/2019 | Smith | F41A 21/28 |
| 2020/0025476 | A1* | 1/2020 | Aubin | F41A 5/26 |
| 2020/0033085 | A1* | 1/2020 | Robinson | F41A 5/28 |
| 2021/0389066 | A1* | 12/2021 | Sylvester | F41A 5/26 |
| 2022/0196354 | A1* | 6/2022 | Nedev | F41A 5/18 |
| 2024/0085129 | A1* | 3/2024 | Zheng | F41A 5/26 |
| 2024/0230260 | A1* | 7/2024 | Sims | F41A 5/28 |

* cited by examiner

GAS BLOCK FOR A FIREARM

FIELD OF THE DISCLOSURE

The present disclosure relates generally to gas blocks for a firearm implementing a direct-impingement gas system and related methods of manufacturing and using the same.

BACKGROUND OF THE DISCLOSURE

Certain types of firearms, such as the AR-15-style rifle, may implement a direct-impingement gas system that uses gas from a fired cartridge to impart force on a bolt carrier or slide assembly to cycle the action of the firearm. Such firearms generally may include a barrel, a gas block secured to the barrel, and a gas tube secured to the gas block. The barrel, the gas block, and the gas tube may be in fluid communication with one another via respective gas ports and arranged to direct a portion of the high-pressure gas from a fired cartridge to the bolt carrier for cycling the action. Upon firing a cartridge, the propellant gas may advance the projectile through the bore of the barrel, and as the projectile moves past a gas port extending from the bore to an outer surface of the barrel, a portion of the gas may flow out of the bore through the gas port of the barrel. The high-pressure gas then may flow through a gas port of the gas block, through a gas port of the gas tube, through a bore of the gas tube, and ultimately to the bolt carrier to cycle the action.

Various techniques have been used for securely installing a gas block on a barrel in manner that achieves desired alignment of the gas port of the gas block with the gas port of the barrel in order to allow for sufficient gas flow therethrough. According to one approach, the barrel may be provided (either during initial manufacture or later during installation of the gas block) with a dimple defined in the outer surface of the barrel opposite the gas port of the barrel, and the gas block may include a set screw hole disposed opposite the gas port of the gas block and configured to allow a set screw to pass therethrough and engage the dimple. Although this approach may be suitable for aligning the gas ports of the barrel and the gas block in certain instances, it may result in undesirable longitudinal and/or rotational misalignment of such gas ports in other instances. According to another approach, the gas block may be pinned to the barrel by drilling a passage through respective portions of the gas block and the barrel and then inserting a taper pin into the drilled passage. Although the pinned connection may provide secure installation of the gas block relative to the barrel, this approach is still susceptible to undesirable longitudinal and/or rotational misalignment of the gas ports of the gas block and the barrel.

A need therefore exists for improved gas blocks and methods for securing a gas block to a barrel of a firearm, which may overcome one or more of the above-mentioned problems associated with existing gas blocks and techniques for installing the same.

SUMMARY OF THE DISCLOSURE

The present disclosure provides gas blocks for a firearm, gas assemblies for a firearm, and methods of manufacturing a gas block for a firearm.

In one aspect, a gas block for a firearm is provided. According to one example, the gas block may include a body, a barrel bore, a gas tube bore, a gas port, and an alignment aperture. The body may have a first end, a second end disposed opposite the first end in a direction of a longitudinal axis of the body, a top side, a bottom side disposed opposite the top side in a direction of a vertical axis of the body, a first lateral side, and a second lateral side disposed opposite the first lateral side in a direction of a transverse axis of the body. The barrel bore may extend from the first end to the second end and may be configured to receive a portion of a barrel therein. The gas tube bore may extend from the first end toward the second end and may be configured to receive a portion of a gas tube therein. The gas port may extend from the barrel bore to the gas tube bore. The alignment aperture may extend from the gas tube bore to the top side and may be coaxial with the gas port. The alignment aperture may be configured to allow visualization of alignment of the gas port with a barrel gas port of the barrel.

In some examples, an inner diameter of the alignment aperture may be less than an inner diameter of the gas port. In some examples, the alignment aperture may have a cylindrical shape. In some examples, the gas port may include a frustoconical portion having a varying inner diameter, and a cylindrical portion having a constant inner diameter. In some examples, the frustoconical portion may extend from the barrel bore to the cylindrical portion, and the cylindrical portion may extend from the frustoconical portion to the gas tube bore. In some examples, an inner diameter of the alignment aperture may be less than the constant inner diameter of the cylindrical portion of the gas port. In some examples, the alignment aperture may be a smooth bore. In some examples, the alignment aperture may be threaded. In some examples, the alignment aperture may be configured to receive at least a portion of an insert therein to selectively close the alignment aperture. In some examples, the gas block also may include an insert configured to be inserted at least partially within the alignment aperture to selectively close the alignment aperture. In some examples, the gas block also may include a first set screw hole extending from the barrel bore to the bottom side and coaxial with the gas port, with the first set screw hole being configured to receive at least a portion of a first set screw therein to selectively secure the gas block to the barrel. In some examples, the gas block also may include a second set screw hole extending from the barrel bore to the bottom side and parallel with the gas port, with the second set screw hole being configured to receive at least a portion of a second set screw therein to selectively secure the gas block to the barrel. In some examples, the gas block also may include a first roll pin hole extending from the gas tube bore to the first lateral side, and a second roll pin hole extending from the gas tube bore to the second lateral side and coaxial with the first roll pin hole, with the first roll pin hole and the second roll pin hole being configured to receive a respective portion of a roll pin to selectively secure the gas block to the gas tube. In some examples, the gas block also may include a pin recess extending from one of the first lateral side or the second lateral side toward a bottom region of the barrel bore, with the pin recess being configured to facilitate pinning of the gas block to the barrel to selectively secure the gas block to the barrel.

In another aspect, a gas assembly for a firearm is provided. According to one example, the gas assembly may include a barrel, a gas tube, and a gas block. The barrel may include a first bore, and a barrel gas port extending from the first bore to an outer surface of the barrel. The gas tube may include a second bore, and a gas tube gas port extending from the second bore to an outer surface of the gas tube. The gas block may include a body, a barrel bore, a gas tube bore, a gas block gas port, and an alignment aperture. The body may have a first end, a second end disposed opposite the first end in a direction of a longitudinal axis of the body, a top side, a bottom side disposed opposite the top side in a direction of a vertical axis of the body, a first lateral side, and a second lateral side disposed opposite the first lateral side in a direction of a transverse axis of the body. The barrel bore may extend from the first end to the second end and may be configured to receive a portion of a barrel therein. The gas tube bore may extend from the first end toward the second end and may be configured to receive a portion of a gas tube therein. The gas block gas port may extend from the barrel bore to the gas tube bore. The alignment aperture may extend from the gas tube bore to the top side and may be coaxial with the gas block gas port. The alignment aperture may be configured to allow visualization of alignment of the gas block gas port with a barrel gas port during assembly of the gas assembly.

In some examples, an inner diameter of the alignment aperture may be less than an inner diameter of the gas tube gas port, and an inner diameter of the barrel gas port may be less than the inner diameter of the gas tube gas port. In some examples, the gas block also may include an insert inserted at least partially within the alignment aperture to selectively close the alignment aperture.

In still another aspect, a method of manufacturing a gas block for a firearm is provided. In one example, the method may include providing a body having a first end, a second end disposed opposite the first end in a direction of a longitudinal axis of the body, a top side, a bottom side disposed opposite the top side in a direction of a vertical axis of the body, a first lateral side, and a second lateral side disposed opposite the first lateral side in a direction of a transverse axis of the body; providing a barrel bore extending from the first end to the second end and configured to receive a portion of a barrel therein; providing a gas tube bore extending from the first end toward the second end and configured to receive a portion of a gas tube therein; providing a gas port extending from the barrel bore to the gas tube bore; and providing an alignment aperture extending from the gas tube bore to the top side and coaxial with the gas port, with the alignment aperture being configured to allow visualization of alignment of the gas port with a barrel gas port of the barrel.

In some examples, an inner diameter of the alignment aperture is less than an inner diameter of the gas port. In some examples, the alignment aperture is configured to receive at least a portion of an insert therein to selectively close the alignment aperture.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain examples of the present disclosure may include elements, components, and/or configurations other than those illustrated in the drawings, and some of the elements, components, and/or configurations illustrated in the drawings may not be present in certain examples.

DETAILED DESCRIPTION OF THE DISCLOSURE

Figure 1A:
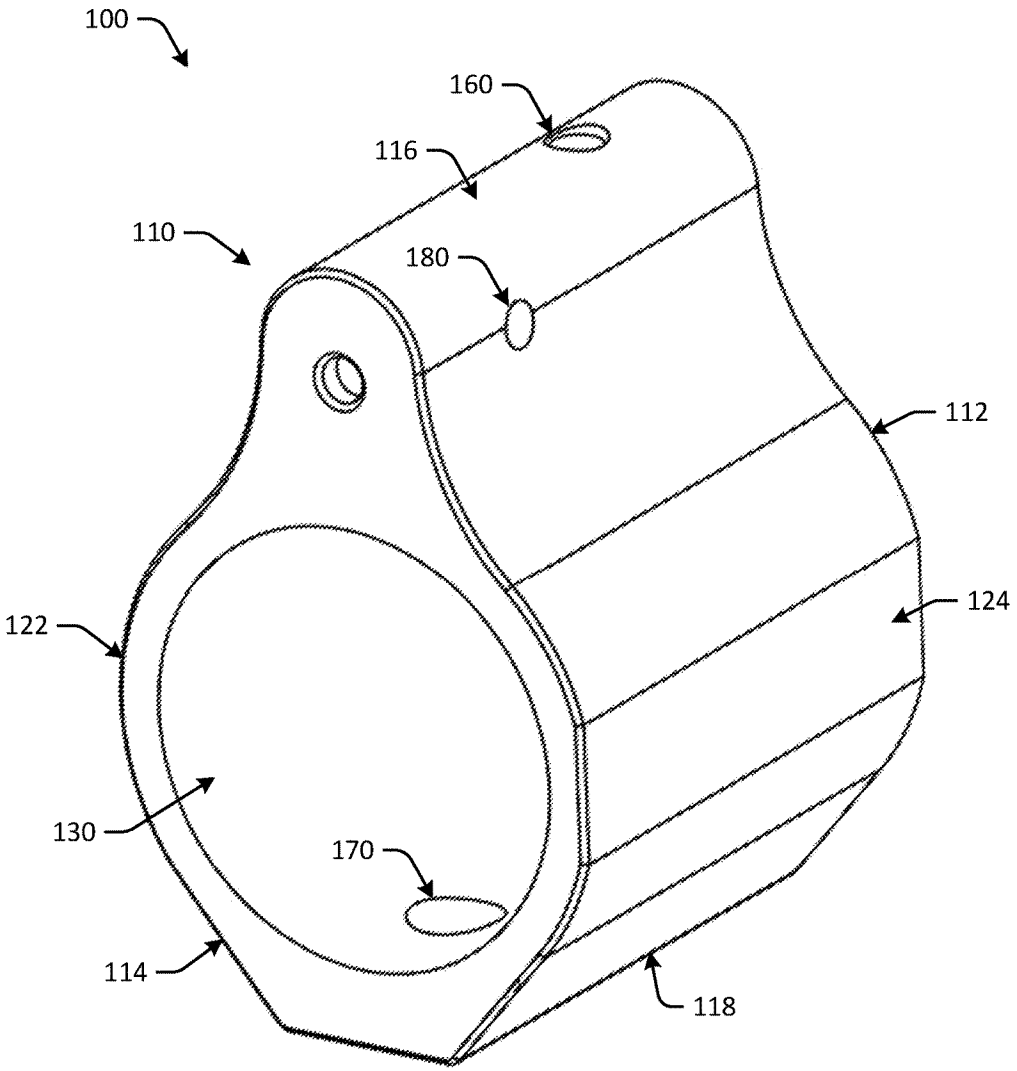
FIG. 1A is a top perspective view of a gas block according to one or more examples of the disclosure.
Figure 1B:
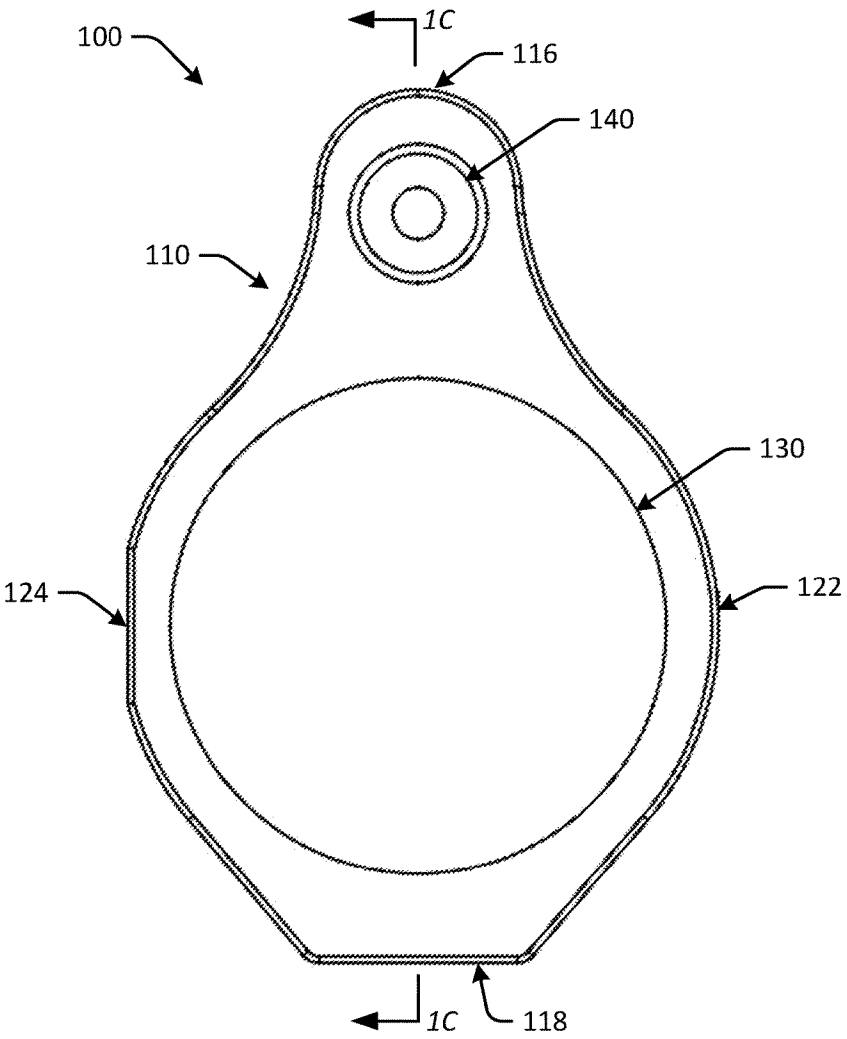
FIG. 1B is an end view of the gas block of FIG. 1A.
Figure 1C:
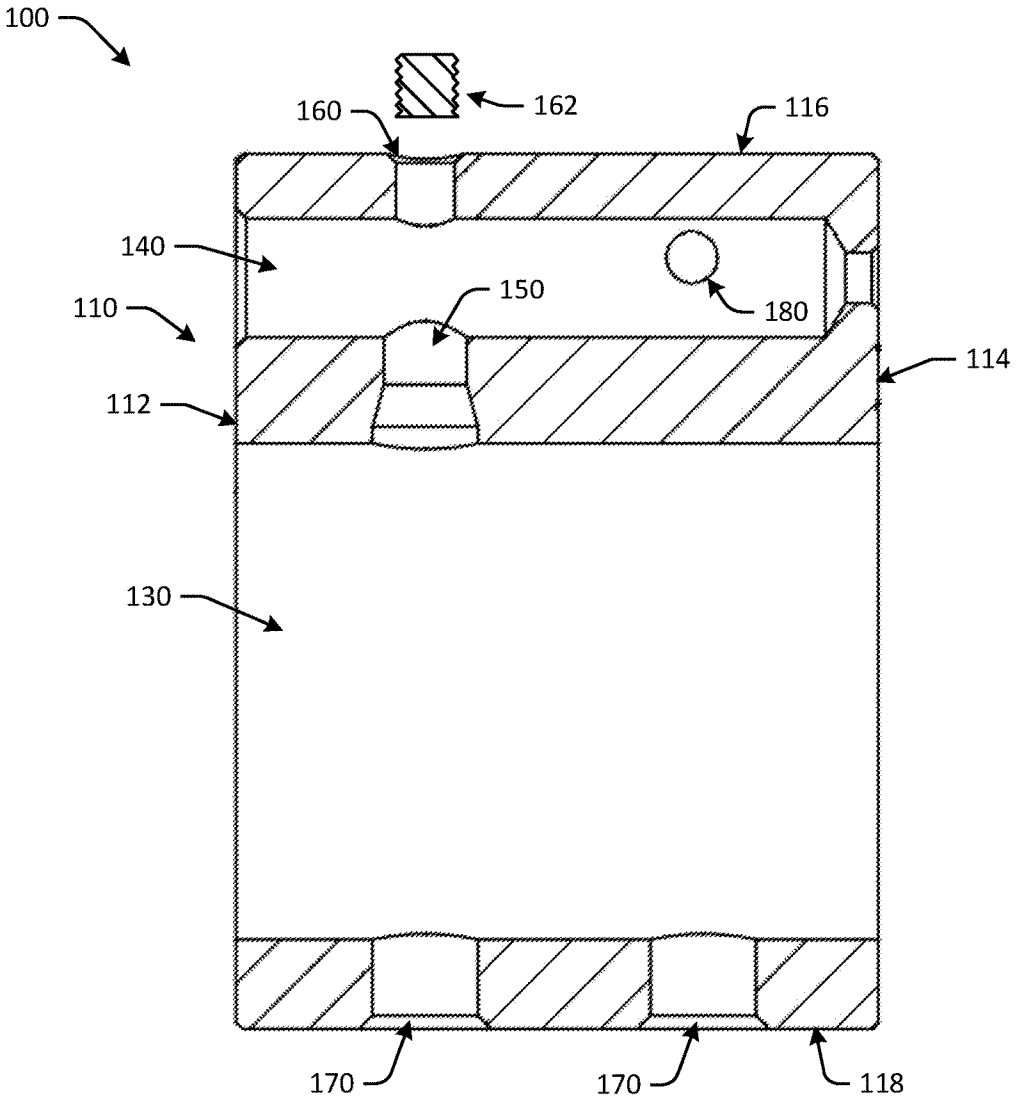
FIG. 1C is a cross-sectional side view of the gas block of FIG. 1A, taken along line 1C-1C of FIG. 1B.
Figure 1D:
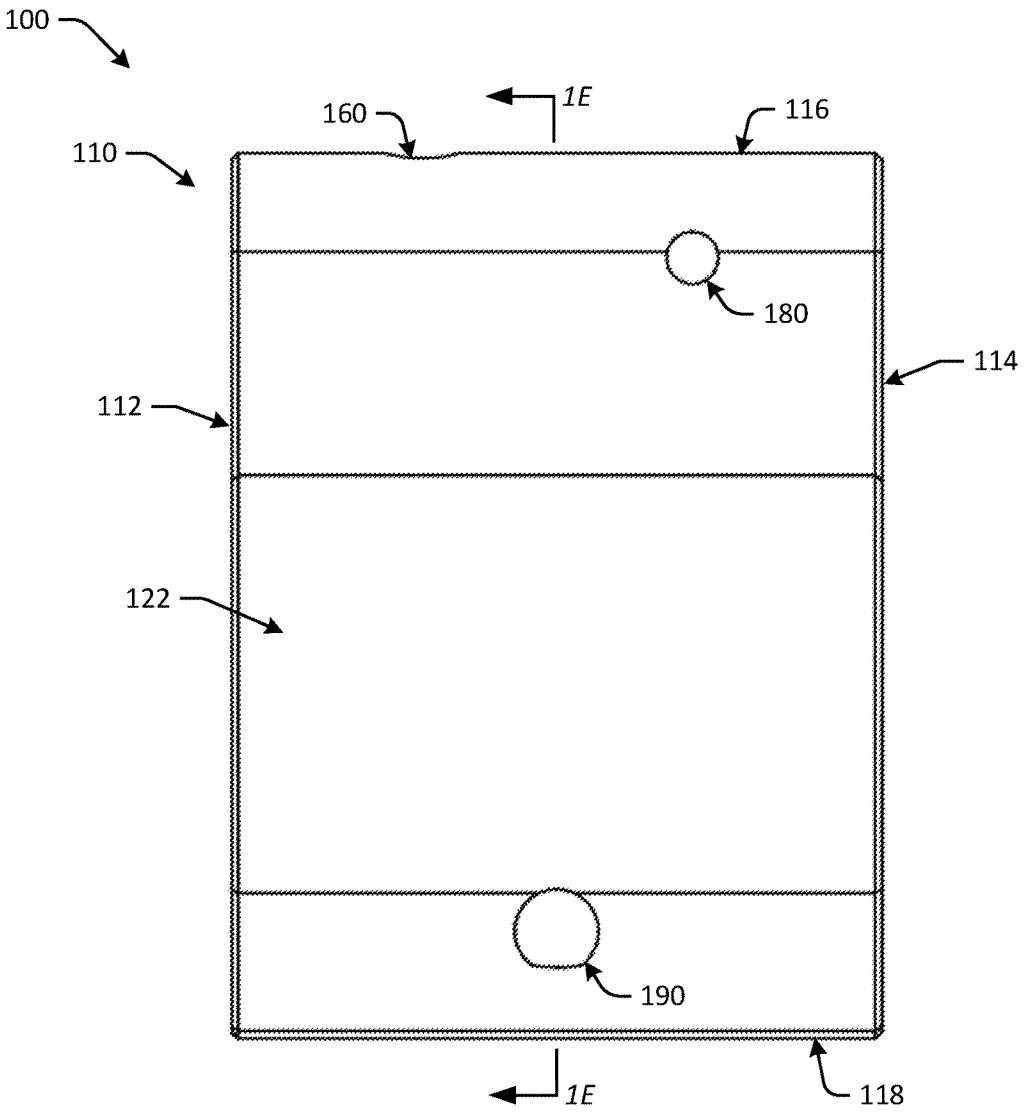
FIG. 1D is a side view of the gas block of FIG. 1A.
Figure 1E:
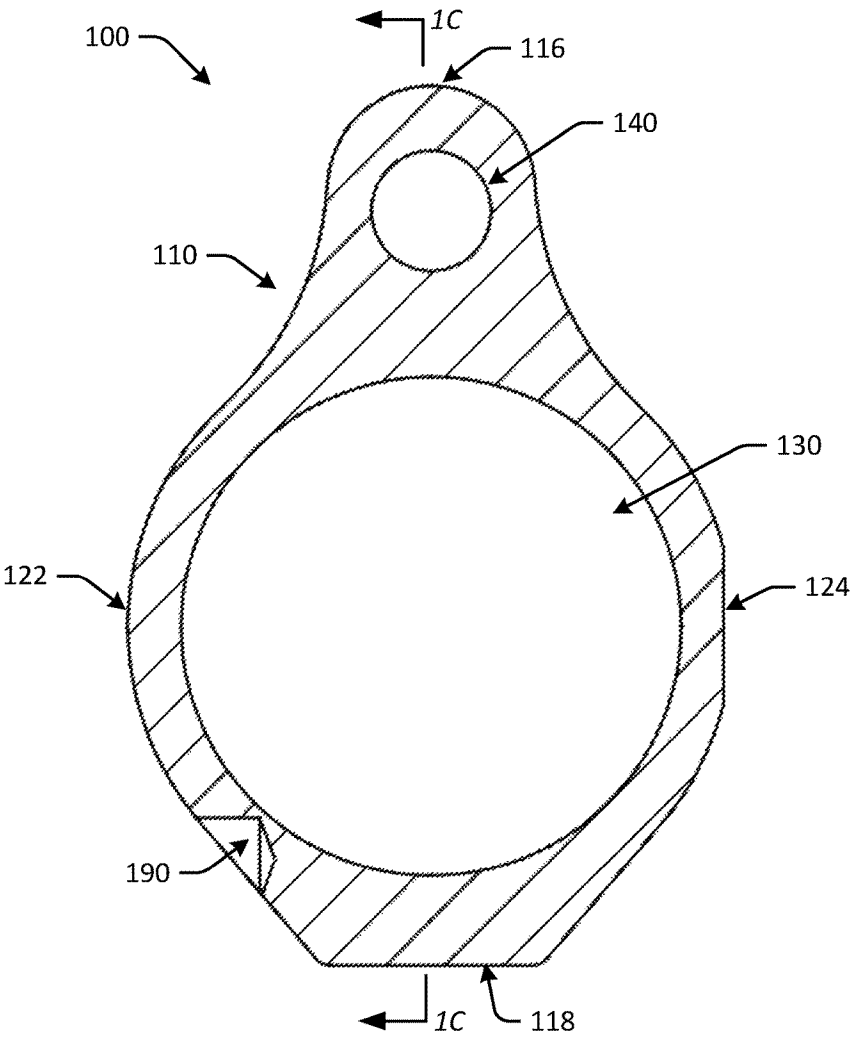
FIG. 1E is a cross-sectional end view of the gas block of FIG. 1A, taken along line 1E-1E of FIG. 1D.

In the following description, specific details are set forth describing some examples consistent with the present disclosure. Numerous specific details are set forth in order to provide a thorough understanding of the examples. It will be apparent, however, to one skilled in the art that some examples may be practiced without some or all of these specific details. The specific examples disclosed herein are meant to be illustrative but not limiting. One skilled in the art may realize other examples that, although not specifically described here, are within the scope and the spirit of this disclosure. In addition, to avoid unnecessary repetition, one or more features shown and described in association with one example may be incorporated into other examples unless specifically described otherwise or if the one or more features would make an example non-functional. In some instances, well known methods, procedures, and components have not been described in detail so as not to unnecessarily obscure aspects of the examples.

The present disclosure provides gas blocks for a firearm, gas assemblies for a firearm, and methods of manufacturing a gas block for a firearm. The gas blocks may be designed for use with certain firearms, such as the AR-15 rifle, which implement a direct-impingement gas system that uses gas from a fired cartridge to impart force on a bolt carrier or slide assembly to cycle the action of the firearm. Such firearms generally may include a barrel, a gas block secured to the barrel, and a gas tube secured to the gas block. The barrel, the gas block, and the gas tube may be in fluid communication with one another via respective gas ports and arranged to direct a portion of the high-pressure gas from a fired cartridge to the bolt carrier for cycling the action. Upon firing a cartridge, the propellant gas may advance the projectile through the bore of the barrel, and as the projectile moves past a gas port extending from the bore to an outer surface of the barrel, a portion of the gas may flow out of the bore through the gas port of the barrel. The high-pressure gas then may flow through a gas port of the gas block, through a gas port of the gas tube, through a bore of the gas tube, and ultimately to the bolt carrier to cycle the action. As discussed above, existing gas blocks and techniques for installing the same on the barrel of a firearm may be susceptible to undesirable longitudinal and/or rotational misalignment of the gas ports of the gas block and the barrel, which may result in insufficient gas flow for cycling the action of the firearm.

According to examples described herein, a gas block may include a body, a barrel bore, a gas tube bore, a gas port, and an alignment aperture. The body may have a first end, a second end disposed opposite the first end in a direction of a longitudinal axis of the body, a top side, a bottom side disposed opposite the top side in a direction of a vertical axis of the body, a first lateral side, and a second lateral side disposed opposite the first lateral side in a direction of a transverse axis of the body. The barrel bore may extend from the first end to the second end and may be configured to receive a portion of a barrel therein. The gas tube bore may extend from the first end toward the second end and may be configured to receive a portion of a gas tube therein. The gas port may extend from the barrel bore to the gas tube bore. The alignment aperture may extend from the gas tube bore to the top side and may be coaxial with the gas port. The alignment aperture may be configured to allow visualization of alignment of the gas port with a barrel gas port of the barrel. In this manner, use of the alignment aperture may inhibit undesirable longitudinal and/or rotational misalignment of the gas ports of the gas block and the barrel and the resulting problems with respect to gas flow.

Still other benefits and advantages of the gas blocks, gas assemblies, and methods provided herein over conventional devices and techniques will be appreciated by those of ordinary skill in the art from the present disclosure.

Example Gas Block

Referring now to the drawings, FIGS. 1A-1E depict a gas block 100 according to one or more examples of the present disclosure. As shown, the gas block 100 may include a body 110, a barrel bore 130, a gas tube bore 140, a gas port 150, and an alignment aperture 160. The body 110 may have a first end 112, a second end 114 disposed opposite the first end 112 in a direction of a longitudinal axis of the body 110, a top side 116, a bottom side 118 disposed opposite the top side 116 in a direction of a vertical axis of the body 110, a first lateral side 122, and a second lateral side 124 disposed opposite the first lateral side 122 in a direction of a transverse axis of the body 110. The barrel bore 130 may extend from the first end 112 to the second end 114 and may be configured to receive a portion of a barrel therein. The gas tube bore 140 may extend from the first end 112 toward the second end 114 and may be configured to receive a portion of a gas tube therein. The gas port 150 may extend from the barrel bore 130 to the gas tube bore 140. The alignment aperture 160 may extend from the gas tube bore 140 to the top side 116 and may be coaxial with the gas port 150. The alignment aperture 160 may be configured to allow visualization of alignment of the gas port 150 with a barrel gas port of the barrel. In this manner, use of the alignment aperture 160 may inhibit undesirable longitudinal and/or rotational misalignment of the gas port 150 of the gas block 100 and the barrel gas port of the barrel and the resulting problems with respect to gas flow.

In some examples, an inner diameter of the alignment aperture 160 may be less than an inner diameter of the gas port 150. In some examples, the alignment aperture 160 may have a cylindrical shape. In some examples, the gas port 150 may include a frustoconical portion having a varying inner diameter, and a cylindrical portion having a constant inner diameter. In some examples, the frustoconical portion may extend from the barrel bore 130 to the cylindrical portion, and the cylindrical portion may extend from the frustoconical portion to the gas tube bore 140. In some examples, an inner diameter of the alignment aperture 160 may be less than the constant inner diameter of the cylindrical portion of the gas port 150. In some examples, the alignment aperture 160 may be a smooth bore. In some examples, the alignment aperture 160 may be threaded. In some examples, the alignment aperture 160 may be configured to receive at least a portion of an insert 162 therein to selectively close the alignment aperture 160. In some examples, the gas block 100 also may include an insert 162 configured to be inserted at least partially within the alignment aperture 160 to selectively close the alignment aperture 160. In some examples, the gas block 100 also may include a first set screw hole 170 extending from the barrel bore 130 to the bottom side 118 and coaxial with the gas port 150, with the first set screw hole 170 being configured to receive at least a portion of a first set screw therein to selectively secure the gas block 100 to the barrel. In some examples, the gas block 100 also may include a second set screw hole 170 extending from the barrel bore 130 to the bottom side 118 and parallel with the gas port 150, with the second set screw hole 170 being configured to receive at least a portion of a second set screw therein to selectively secure the gas block 100 to the barrel. In some examples, the gas block 100 also may include a first roll pin hole 180 extending from the gas tube bore 140 to the first lateral side 122, and a second roll pin hole 180 extending from the gas tube bore 140 to the second lateral side 124 and coaxial with the first roll pin hole 180, with the first roll pin hole 180 and the second roll pin hole 180 being configured to receive a respective portion of a roll pin to selectively secure the gas block 100 to the gas tube. In some examples, the gas block 100 also may include a pin recess 190 extending from one of the first lateral side 122 or the second lateral side 124 toward a bottom region of the barrel bore 130, with the pin recess 190 being configured to facilitate pinning of the gas block 100 to the barrel to selectively secure the gas block 100 to the barrel.

Figure 1F:
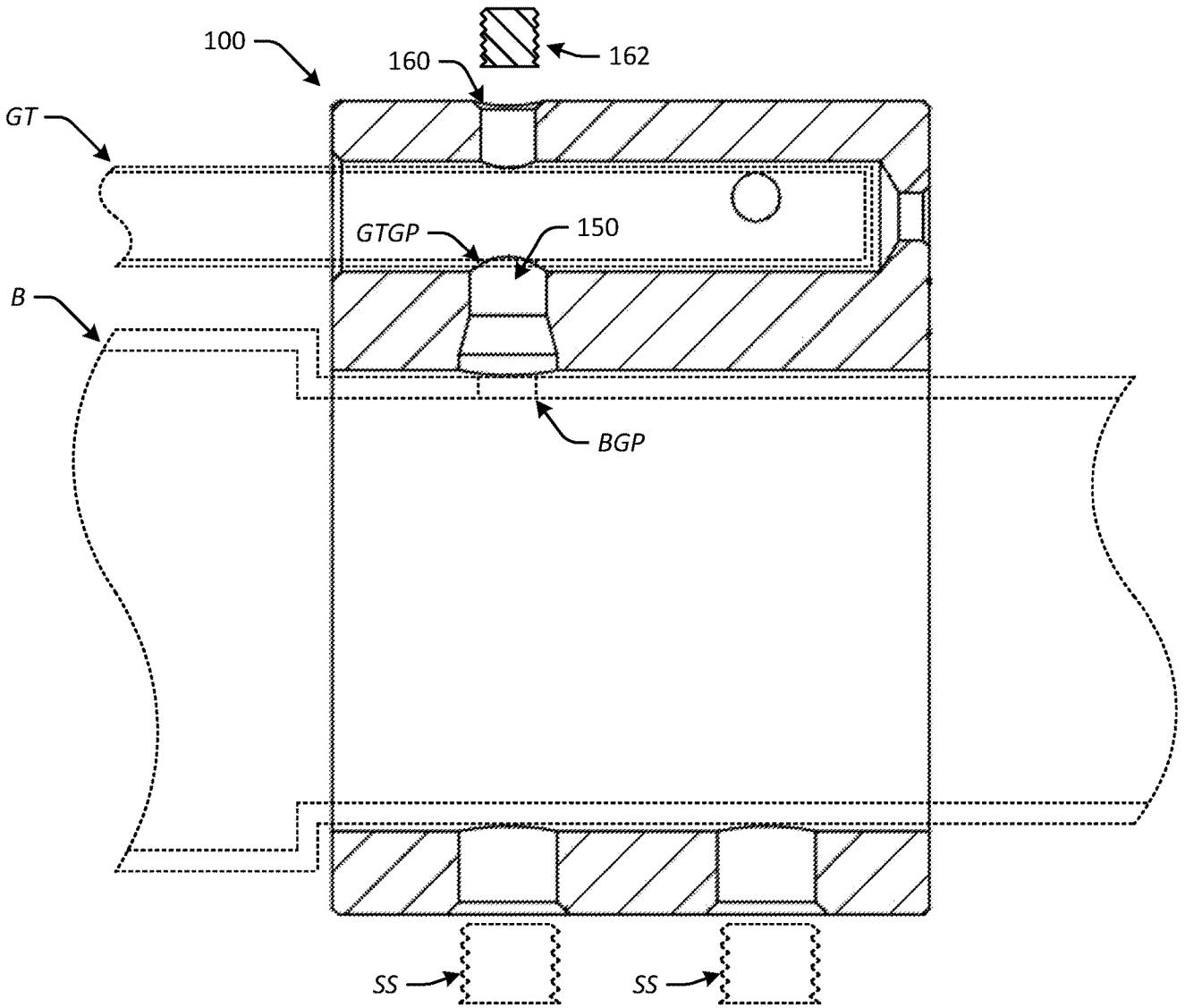
FIG. 1F is a cross-sectional side view of the gas block of FIG. 1A, showing the gas block positioned relative to a barrel and a gas tube of a gas assembly.

FIG. 1F illustrates an example of the gas block 100 positioned relative to a barrel B and a gas tube GT of a gas assembly. As shown, the gas block 100 may be positioned relative to the barrel B such that the gas port 150 thereof is aligned with a barrel gas port BGP of the barrel B. As discussed above, the alignment aperture 160 may be used to visualize alignment of the gas port 150 and the barrel gas port BGP. A pair of set screws SS may be used to selectively secure the gas block 100 to the barrel B. As shown, the gas tube GT may be positioned relative to the gas block 100 such that a gas tube gas port GTGP of the gas tube GT is aligned with the gas port 150 and the barrel gas port BGP. If desired, the insert 162 may be used to selectively close the alignment aperture 160. The insert 162 may be threaded for threadedly engaging the alignment aperture 160, although other means of connection may be used.

Although specific examples of the disclosure have been described, numerous other modifications and alternative examples are within the scope of the disclosure. For example, any of the functionalities described with respect to a particular device or component may be performed by another device or component. Further, while specific device characteristics have been described, examples of the disclosure may relate to numerous other device characteristics. Further, although examples have been described in language specific to structural features and/or methodological acts, it is to be understood that the disclosure is not necessarily limited to the specific features or acts described. Rather, the specific features and acts are disclosed as illustrative forms of implementing the examples. Conditional language, such as, among others, "can," "could," "might," or "may," unless specifically stated otherwise, or otherwise understood within the context as used, is generally intended to convey that certain examples could include, while other examples may not include, certain features, elements, and/or steps. Thus, such conditional language is not generally intended to imply that features, elements, and/or steps are in any way required for one or more examples.

We claim:

1. A gas block for a firearm, the gas block comprising:

a body having a first end, a second end disposed opposite the first end in a direction of a longitudinal axis of the body, a top side, a bottom side disposed opposite the top side in a direction of a vertical axis of the body, a first lateral side, and a second lateral side disposed opposite the first lateral side in a direction of a transverse axis of the body;

a barrel bore extending from the first end to the second end and configured to receive a portion of a barrel therein;

a gas tube bore extending from the first end toward the second end and configured to receive a portion of a gas tube therein;

a gas port extending from the barrel bore to the gas tube bore, wherein the gas port includes a cylindrical portion with an inner diameter and a frustoconical portion which extends from the barrel bore to the cylindrical portion, wherein the cylindrical portion extends from the frustoconical portion to the gas tube bore; and an alignment aperture extending from the gas tube bore to the top side and coaxial with the gas port, wherein the alignment aperture is configured to allow visualization of alignment of the gas port with a barrel gas port of the barrel, wherein an inner diameter of the alignment aperture is less than the inner diameter of the cylindrical portion of the gas port.

2. The gas block of claim 1, wherein an inner diameter of the alignment aperture is less than an inner diameter of the gas port.

3. The gas block of claim 1, wherein the alignment aperture has a cylindrical shape.

4. The gas block of claim 1, wherein the gas port comprises: the frustoconical portion having a varying inner diameter; and the cylindrical portion having a constant inner diameter.

5. The gas block of claim 1, wherein the alignment aperture is a smooth bore.

6. The gas block of claim 1, wherein the alignment aperture is threaded.

7. The gas block of claim 1, wherein the alignment aperture is configured to receive at least a portion of an insert therein to selectively close the alignment aperture.

8. The gas block of claim 1, further comprising an insert configured to be inserted at least partially within the alignment aperture to selectively close the alignment aperture.

9. The gas block of claim 1, further comprising a first set screw hole extending from the barrel bore to the bottom side and coaxial with the gas port, wherein the first set screw hole is configured to receive at least a portion of a first set screw therein to selectively secure the gas block to the barrel.

10. The gas block of claim 9, further comprising a second set screw hole extending from the barrel bore to the bottom side and parallel with the gas port, wherein the second set screw hole is configured to receive at least a portion of a second set screw therein to selectively secure the gas block to the barrel.

11. The gas block of claim 1, further comprising:

a first roll pin hole extending from the gas tube bore to the first lateral side; and a second roll pin hole extending from the gas tube bore to the second lateral side and coaxial with the first roll pin hole, wherein the first roll pin hole and the second roll pin hole are configured to receive a respective portion of a roll pin to selectively secure the gas block to the gas tube.

12. The gas block of claim 1, further comprising a pin recess extending from one of the first lateral side or the second lateral side toward a bottom region of the barrel bore, wherein the pin recess is configured to facilitate pinning of the gas block to the barrel to selectively secure the gas block to the barrel.

13. A gas assembly for a firearm, the gas assembly comprising:

a barrel comprising:

a first bore; and a barrel gas port extending from the first bore to an outer surface of the barrel;

a gas tube comprising:

a second bore; and a gas tube gas port extending from the second bore to an outer surface of the gas tube; and a gas block comprising:

a body having a first end, a second end disposed opposite the first end in a direction of a longitudinal axis of the body, a top side, a bottom side disposed opposite the top side in a direction of a vertical axis of the body, a first lateral side, and a second lateral side disposed opposite the first lateral side in a direction of a transverse axis of the body;

a barrel bore extending from the first end to the second end and receiving a portion of a barrel disposed therein;

a gas tube bore extending from the first end toward the second end and receiving a portion of the gas tube therein;

a gas block gas port extending from a gas bore of the barrel to the gas tube bore, wherein the gas block gas port includes a frustoconical portion having a varying inner diameter and a cylindrical portion having a constant inner diameter; and an alignment aperture extending from the gas tube gas tube bore to the top side and coaxial with the gas tube gas port, wherein the alignment aperture is configured to allow visualization of alignment of the gas tube gas port with the barrel gas port during assembly of the gas assembly, wherein an inner diameter of the alignment aperture is less than the inner diameter of the cylindrical portion of the gas block gas port.

14. The gas assembly of claim 13, wherein an inner diameter of the alignment aperture is less than an inner diameter of the gas tube gas port, and wherein an inner diameter of the barrel gas port is less than the inner diameter of the gas tube gas port.

15. The gas assembly of claim 13, wherein the gas block further comprises an insert inserted at least partially within the alignment aperture to selectively close the alignment aperture.

16. A method of manufacturing a gas block for a firearm, the method comprising:

providing a body having a first end, a second end disposed opposite the first end in a direction of a longitudinal axis of the body, a top side, a bottom side disposed opposite the top side in a direction of a vertical axis of the body, a first lateral side, and a second lateral side disposed opposite the first lateral side in a direction of a transverse axis of the body;

providing a barrel bore extending from the first end to the second end and configured to receive a portion of a barrel therein;

providing a gas tube bore extending from the first end toward the second end and configured to receive a portion of a gas tube therein;

providing a gas port extending from the barrel bore to the gas tube bore, wherein the gas port includes a cylindrical portion with an inner diameter and a frustoconical portion which extends from the barrel bore to the cylindrical portion, wherein the cylindrical portion extends from the frustoconical portion to the gas tube bore; and providing an alignment aperture extending from the gas tube bore to the top side and coaxial with the gas port, wherein the alignment aperture is configured to allow visualization of alignment of the gas port with a barrel gas port of the barrel, wherein an inner diameter of the alignment aperture is less than the inner diameter of the cylindrical portion of the gas port.

17. The method of claim 16, wherein an inner diameter of the alignment aperture is less than an inner diameter of the gas port.

18. The method of claim 16, wherein the alignment aperture is configured to receive at least a portion of an insert therein to selectively close the alignment aperture.

* * * * *